US005445552A

United States Patent [19]

Hine

[11] Patent Number: 5,445,552

[45] Date of Patent: Aug. 29, 1995

[54] ELECTRICALLY AND/OR MECHANICALLY INTERCONNECTABLE MINIATURE BASE

[75] Inventor: John Hine, Aldershot, England

[73] Assignee: John Hine Limited, United Kingdom

[21] Appl. No.: 184,765

[22] Filed: Jan. 21, 1994

Related U.S. Application Data

[63] Continuation of Ser. No. 996,543, Dec. 24, 1992, abandoned.

[51] Int. Cl.[6] ..... A63H 33/00

[52] U.S. Cl. ..... 446/477; 446/91; 446/485; 362/249

[58] Field of Search ..... 446/91, 477, 484, 485; 362/238, 249, 236, 239

[56] References Cited

U.S. PATENT DOCUMENTS

| | | | |
|---|---|---|---|
| 2,103,447 | 12/1937 | Carl . | |
| 2,345,792 | 4/1944 | Cann | 312/100 |
| 2,544,034 | 3/1951 | Levering | 446/477 |
| 2,664,665 | 1/1954 | Rozenoff . | |
| 3,107,135 | 10/1963 | Keil | 339/103 |
| 3,484,984 | 12/1969 | Fischer | 446/91 |
| 3,629,680 | 12/1971 | Baynes et al. | 446/484 X |
| 3,696,548 | 10/1972 | Teller | 446/91 |
| 4,639,841 | 1/1987 | Salestrom et al. | 362/249 X |
| 4,824,393 | 4/1989 | Armbruster | 439/332 |
| 4,938,730 | 7/1990 | Yamane et al. | 446/130 |
| 4,941,859 | 7/1990 | Zaruba | 446/476 |

FOREIGN PATENT DOCUMENTS

| | | | |
|---|---|---|---|
| 1160438 | 7/1958 | France | 446/477 |

*Primary Examiner*—Mickey Yu
*Attorney, Agent, or Firm*—Kenyon & Kenyon

[57] ABSTRACT

A base unit adapted to accommodate a miniature building, having a lamp unit, and adapted to be mechanically and/or electrically connected to further, similar base units.

7 Claims, 4 Drawing Sheets

FIG. 1A
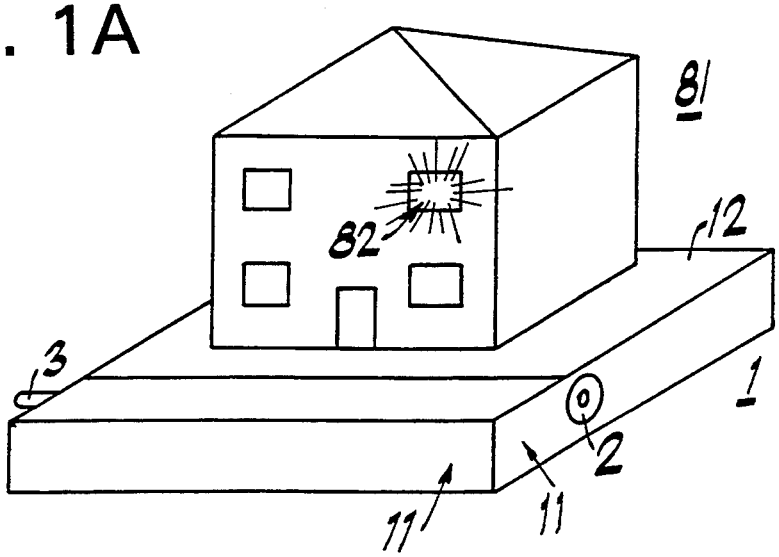
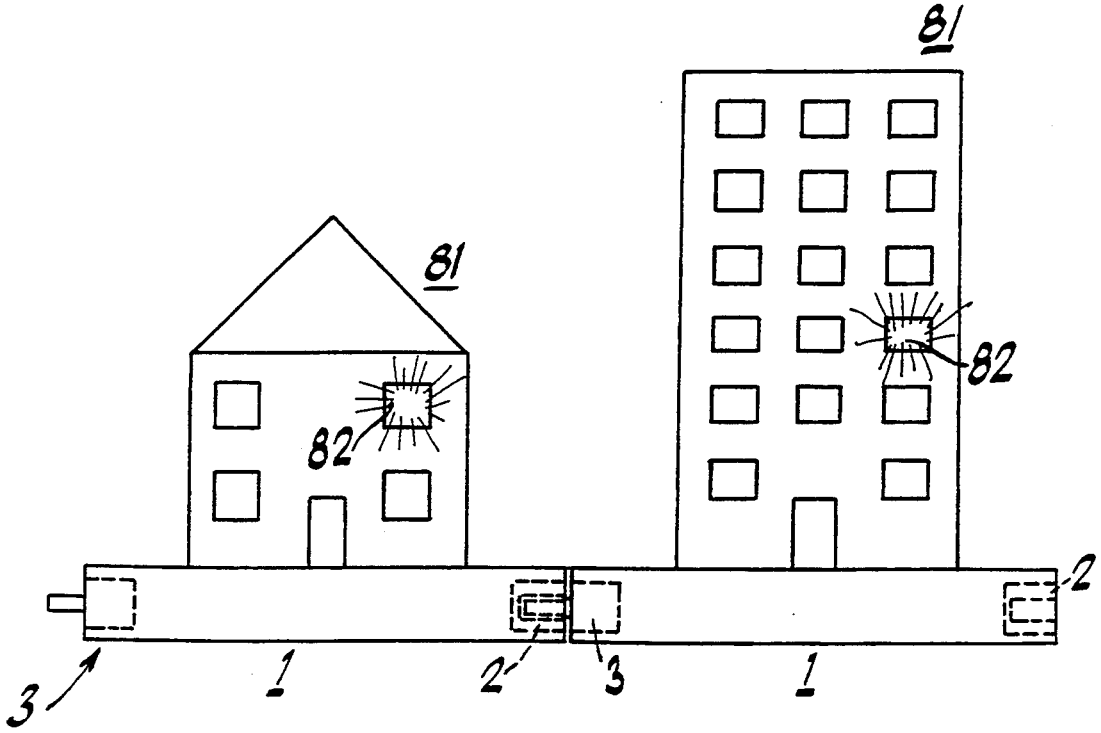
FIG. 1B

FIG. 2A
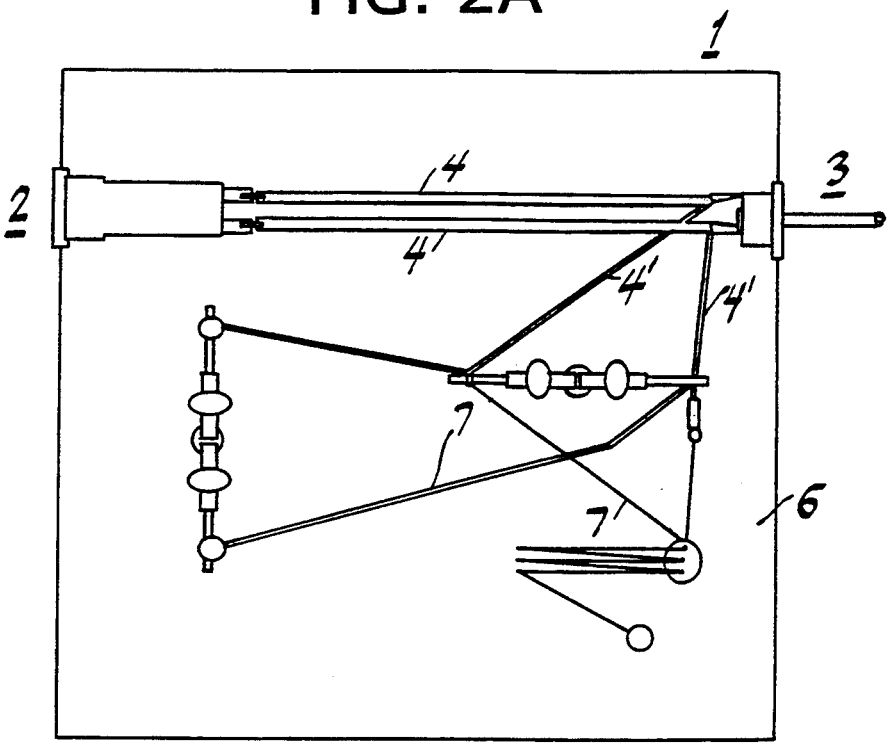
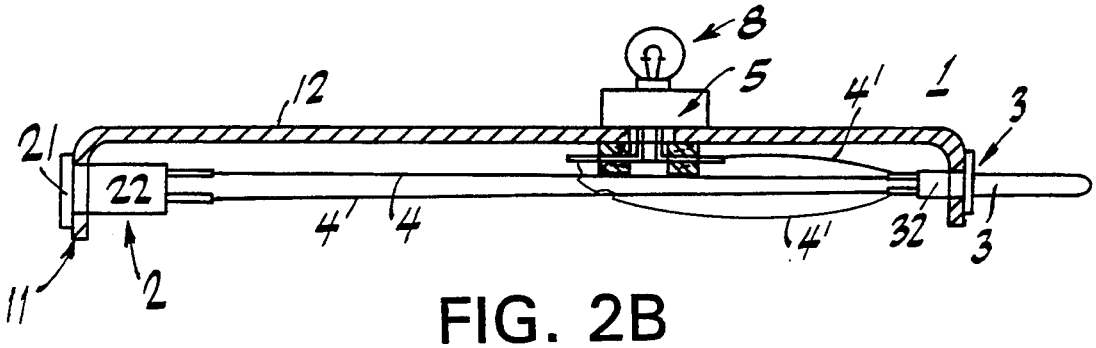
FIG. 2B

FIG. 6A
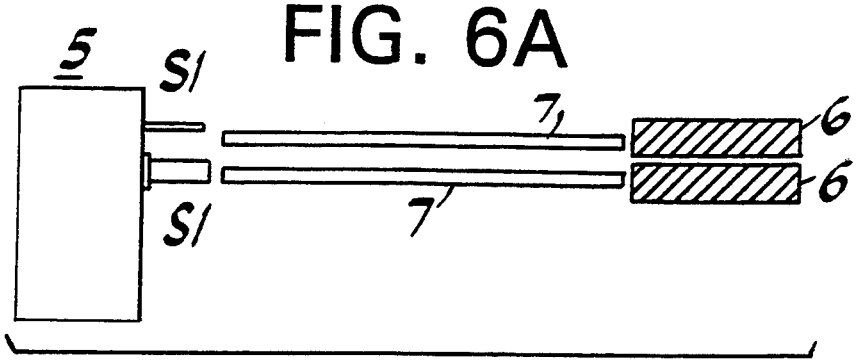
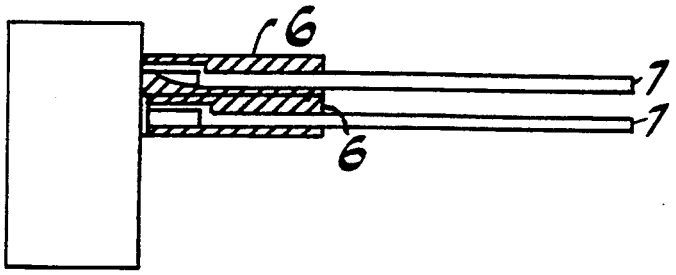
FIG. 6B
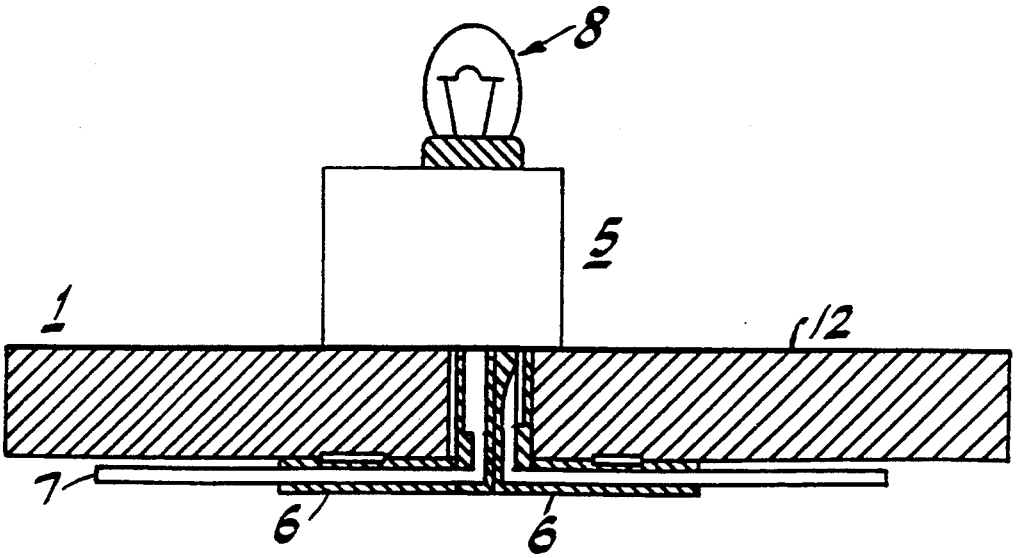
FIG. 7

ELECTRICALLY AND/OR MECHANICALLY INTERCONNECTABLE MINIATURE BASE

This application is a continuation of application Ser. No. 07/996,543, filed on Dec. 24, 1992 now abandoned.

BACKGROUND OF THE INVENTION

The present invention relates to collectable miniatures, and in particular, to a base unit adapted to accommodate a miniature building, the base unit having an electrical lamp fitting, and adapted to electrically and/or mechanically interconnect with other base units.

In the past, some miniature buildings were provided with a lightable interior (see, e.g., U.S. Pat. No. 4,938,730). However, such miniature buildings we, designed as a stand alone unit rather than as one unit of a collectable series able to be interconnected. Further, if producing a series of such miniatures were desired, a separate power supply would be required for each unit. In addition, the methods for producing such lighted miniatures often produced a miniature having unreliable lighting. Also, in the past, miniature buildings were mechanically interconnected by providing at least one pin on each building base and a connecting piece with at least two holes adapted to lock with the pin (see e.g. U.S. Pat. No. 4,941,859). However, such an arrangement required separate connecting pieces and did not provide any means for lighting or providing an electrical connection.

An object of the present invention is to provide a base unit adapted to accommodate a collectable miniature building, adapted to accommodate at least one electrical lighting means, and including at least one means adapted to provide an electrical and/or mechanical interconnection to similar base units. A further object of the present invention is to provide a method for constructing such a base.

SUMMARY OF THE INVENTION

The present invention meets the aforementioned goal by providing a base unit for accommodating a miniature collectable including a support plate, a socket, a plug, a lamp holder, a first conducting means and a second conducting means. The support plate includes a top portion and a peripheral wall portion which define a cavity. The socket is adapted to accept a plug whereby an electrical and mechanical connection may be formed and has a surface substantially flush with an outside surface of the peripheral wall. The plug projects beyond an outside surface of the peripheral wall and is adapted to fit into a socket whereby an electrical and mechanical connection may be formed. The lamp housing assembly is connected to the top portion of the support plate. The first means for electrical conduction electrically connects the socket and the plug. The second means for electrical conduction electrically connects the lamp housing and the plug.

In a preferred embodiment, two end units, i.e., two base units adapted to accommodate miniature buildings, and a power supply is provided such that additional base units can be connected, in any desired order, between the two end units.

The present invention also provides a method for building such a base unit including steps of preparing the plug, preparing the socket, preparing the lamp housing assembly, preparing the support plate, and wiring the base assembly.

BRIEF DESCRIPTION OF THE DRAWING

FIG. 1A is a perspective view of a miniature building accommodated on a base unit according to the present invention.

FIG 1B is a front view of two miniature buildings accommodated on two mechanically and electrically interconnected base units.

FIG. 2A is a bottom view of a base unit according to the present invention.

FIG. 2B is a cross-sectional side view of the base unit shown in FIG. 2A.

FIGS. 6A and 6B illustrate a lamp housing preparation step used in a method to create a base unit according to the present invention.

FIG 7 illustrates an assembled lamp housing and bulb used in the base unit of the present invention.

DETAILED DESCRIPTION

Figure 3:
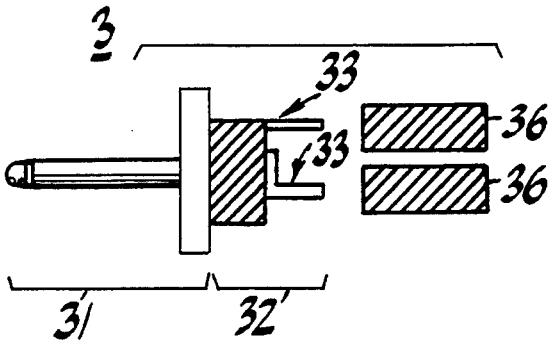
FIG. 3 illustrates a plug connector preparation step used in a method to create a base unit according to the present invention.

FIG. 1A is a perspective view of a miniature building 81 supported on a base unit 1. The miniature building includes a light 82. The base unit 1 includes peripheral walls 11 and a top surface 12. A socket connector 2 and a plug connector 3 are located at opposing peripheral walls 11. FIG. 1B illustrates the manner in which two (or more) miniature buildings and base unit assemblies are electrically and mechanically interconnected via the plug connector 3 and the socket connector 2. The base unit 1 of these assemblies and a method for producing such a base unit 1 are described in more detail below.

FIGS. 2A and 2B are a bottom view and a cross-sectional side view, respectively, of a base unit according to the present invention. The base unit includes a support plate 1 which includes a top portion 12 and a peripheral wall 11 which define a cavity. In a preferred embodiment, the peripheral wall 11 is normal to the top portion 12.

A void is formed in the top portion 12 of the support plate 1 in which a lamp housing 5 may be accommodated (see FIGS. 2A, 2B, and 7). The lamp housing 5 is adapted to receive a lamp bulb 8. The lamp housing 5 includes contacts 51 to which wire leads 7 (e.g., 20 S.W.G. tinned copper wire) are attached (e.g., by soldering). Heatshrink 6 is provided at the attachment point of the lamp housing contacts 51 and the wire leads 7 (see FIG. 6B). As shown in FIG. 7, the bottom end of the wire lead 7 is bent so as to be substantially parallel to a plane formed by the top portion 12 of the support plate 1. A contact adhesive (e.g., "LOCTITE 495" TM) bonds the heatshrink 6 to the inside surface of the top portion 12 of the support plate 1.

Figure 5:
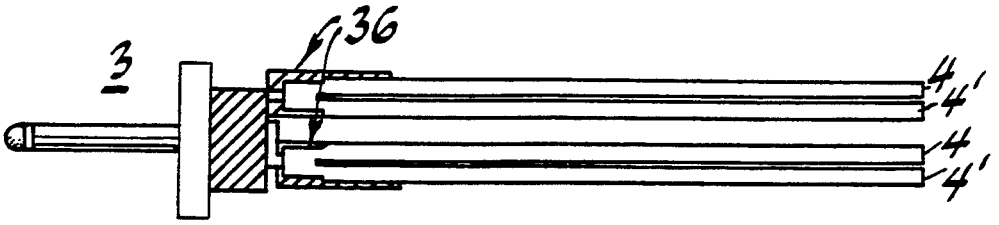
FIG. 5 illustrates an intermediate plug connector assembly step used in a method to create a base unit according to the present invention.

As shown in FIGS. 2A and 2B, the support plate 1 further includes a jack plug connector 3. This jack plug connector is housed in a void formed in the peripheral wall 11 of the support plate 1. As shown in FIG. 2B, the jack plug 3 includes an outer portion 31 which projects from the peripheral wall 11 of the support plate 1. In a preferred embodiment, the outer portion 31 of the jack plug 3 is oriented substantially normal to a side of the peripheral wall 11 of the support plate 1. As shown in FIGS. 3 and 5, the inner portion 32 of the jack plug 3 includes contacts 33 to which wire pairs 4,4' 4,4' (e.g., 7/0.2 wire) are connected (e.g., by soldering). Further, heatshrink 36 is provided at the attachment points of the contacts 33 and the wire pairs 4,4'. As shown in FIGS. 2A and 2B, one wire 4' of each of the wire pairs 4,4' is connected to each of the bulb wires 7. The jack plug connector 3 is adapted to mechanically and electrically connect to a jack socket of a separate base unit.

Figure 4:
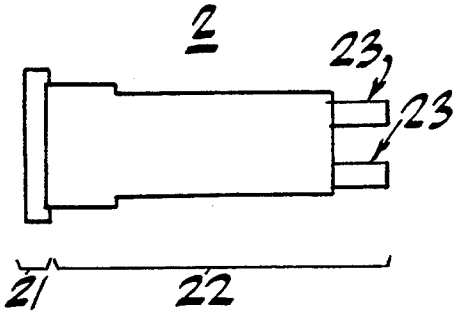
FIG. 4 illustrates a socket connector preparation step used in a method to create a base unit according to the present invention.

Lastly, as shown in FIGS. 2A and 2B, a second void is formed in the peripheral wall 11 of the support plate 1 which houses a jack socket 2. As shown in FIGS. 2B and 4, the jack socket 2 includes an outer portion 21 arranged substantially flush with the outside surface of the peripheral wall 11 and an inner portion 22. The inner portion 22 includes connectors 23. These connectors are attached (e.g., by soldering) to a second end of a second wire 4 of each of the wire pairs 4,4'. The jack socket connector is adapted to mechanically and electrically connect to a jack plug connector of a separate base unit.

In a preferred embodiment, the base is an electrical insulator, e.g., a plastic.

In a preferred embodiment, a series of base units is provided including two end units, and a power supply. In such an arrangement, base units adapted to accommodate miniature buildings can be connected, in any desired order, between the two end units. Electrically activated elements, other than light bulbs, may be installed onto a base unit according to the present invention.

A method for constructing the above described base unit is illustrated in the drawings and described below. The method generally describes steps of preparing the plug connector, preparing the socket connector, preparing the bulb holder, preparing the support plate, and wiring the base unit. The following steps indicate the parameters of a preferred embodiment. However, the scope of the present invention is not limited to these parameters and equivalent modifications will be apparent to those skilled in the art.

Two wire pairs 4,4' and 4,4' are prepared in advance. FIGS. 6A, 6B, and 7 illustrate the preparation of the bulb holder. As shown in FIG. 6A, two lengths of 20 S.W.G. tinned copper wire are cut to 50mm. A first end of the wires are then soldered to the terminals 51 of the lamp housing 5. In doing so, the end of the wires should not protrude into the bulb housing. Otherwise, bulb insertion would be prevented. Two 1.2mm diameter, 20mm long sections of heatshrink 6 are then provided at the connection. As shown in FIG. 7, the bulb holder assembly is fit onto the top portion 12 of the support plate 1 and the wire is passed through a void and bent at approximately right angles to secure the assembly to the support plate 1. The heatshrink 6 is then connected to the inside surface of the top portion 12 of the support plate 1 using a contact adhesive (e.g. "LOCTITE 495" TM ). In doing so, the adhesive should not enter the void in the support plate 1. Otherwise, the adhesive may wick (i.e., flow along the strands and under the insulation of the lead wire) into the bulb aperture and cause intermittent connections. Once this adhesive cures, a bulb 8 may then be inserted into the bulb housing 5.

FIGS; 2A and 2B illustrate the steps of preparing and wiring the base plate. The plug assembly 3 and the socket 2 are positioned in voids formed in the peripheral wall 11 of the support plate 1 and connected to the support plate with adhesive. As shown in FIG. 2A, one wire 4 of each wire pair 4,4' is routed towards the socket connector. About 4mm of insulation is removed from a second end of the wires 4 and these ends are then tinned (i.e., the ends have lead-tine foil or tin plating melted upon them). Lastly, these ends are soldered to the socket terminals 23.

The other wires 4' of each wire pair 4,4' are then routed toward the 20 S.W.G. tinned copper wires 7 of the lamp holder assembly and are cut to extend 5mm beyond the wires 7.5 mm of insulation is removed from the second end to the other wires 4' and the uninsulated portion is wrapped around the wires 7 of the lamp housing assembly.

A street lamp assembly similar to that of the bulb housing assembly may also be attached to a further void formed in the top portion 12 of the base 1 with additional wires extending from the wires 7 of the lamp housing assembly, or from the other wires 4' of the wire pairs 4,4'. However, when connecting the heatshrink to the inside surface of the top part 11 of the support plate 1, sufficient slack should remain to permit the street lamp assembly to be lifted from the void and laid flat against the outside surface of the top part 11 of the support plate when shipping. A resistor is soldered between the lamp housing assembly wires 7 and the additional wire.

Lastly, all soldered connections are checked for any signs of solder splash or poor connection. The unit may be tested with a 12 V A.C. current limited supply to insure that all lamps illuminate.

These and other benefits of the unique base unit will be apparent to those of ordinary skill in the art based on the description of the present invention provided in the specification and drawings.

What is claimed is:

1. An arrangement of miniature buildings including:

a) a power supply;

b) a first end unit including a plug connector;

c) a second end unit including a socket connector;

d) at least one interconnectable base assembly adapted to accommodate a miniature building including:

i) a support plate, said support plate including a top portion and a peripheral wall portion defining a cavity, said peripheral wall having a lower edge surface located opposite said support plate, said lower edge surface defining a substantially flat plane such that said interconnectable base assembly may stably rest on a flat surface;

ii) a socket, said socket adapted to accept a plug whereby an electrical connection and a mechanical connection may be formed;

iii) a plug, said plug, adapted to fit into a socket whereby an electrical connection and a mechanical connection may be formed, wherein said mechanical connection permits the interconnectable base assembly to be rotated about an axis defined by said plug, and projecting beyond an outside surface of said peripheral wall;

iv) means for electrical conduction, said means for electrical conduction electrically connecting said socket and said plug;

v) a lamp housing assembly, said lamp housing assembly connected to said top portion of said support plate; and vi) second means for electrical conduction, said second means for electrical conduction electrically connecting said lamp housing with said plug; and e) a miniature building, said miniature building resting on said support plate of said at least one interconnectable base assembly and surrounding said lamp housing assembly, wherein, a number of said at least one interconnectable base assemblies are connected, in any order, between said first end unit and said second end unit and to said power supply.

2. An arrangement of miniature buildings including:

a) a power supply;

b) a first end unit including a plug connector;

c) a second end unit including a socket connector;

d) at least one interconnectable base assembly adapted to accommodate a miniature building including:

i) a support plate, said support plate including a top potion and a peripheral wall portion defining a cavity, said peripheral wall having a lower edge surface located opposite said support plate, said lower edge surface defining a substantially flat plane such that said interconnectable base assembly may stably rest on a flat surface, said top portion including an inner surface and an outer surface;

ii) a socket, said socket adapted to accept a plug whereby an electrical and mechanical connection may be formed;

iii) a plug, said plug, adapted to fit into a socket whereby an electrical and mechanical connection may be formed, wherein said mechanical connection permits the interconnectable base assembly to be rotated about an axis defined by said plug, and projecting beyond an outside surface of said peripheral wall;

iv) means for electrical conduction, said means for electrical conduction electrically connecting said socket and said plug;

v) a lamp housing assembly, said lamp housing assembly including a terminal lead portion and a lamp portion, said lamp housing assembly accommodated in a void in said support plate such that said terminal lead portion is adjacent to said inner surface of said support plate and said lamp portion is adjacent to said outer surface of said support plate; and vi) second means for electrical conduction, said second means for electrical conduction electrically connecting said lamp housing with said plug; and e) a miniature building, said miniature building resting on said support plate of said at least one interconnectable base assembly and surrounding said lamp housing assembly, wherein, a number of said at least one interconnectable base assemblies are connected, in any order, between said first end unit and said second end unit and to said power supply.

3. An arrangement of miniature buildings including:

a) a power supply;

b) a first end unit including a plug connector;

c) a second end unit including a socket connector;

d) at least one interconnectable base assembly adapted to accommodate a miniature building including:

i) a support plate having an inner surface and an outer surface;

ii) a socket, said socket adapted to accept a plug whereby an electrical and mechanical connection may be formed;

iii ) a plug, said plug, adapted to fit into a socket whereby an electrical and mechanical connection may be formed, wherein said mechanical connection permits the interconnectable base to be rotated about an axis defined by said plug;

iv) means for electrical conduction, said means for electrical conduction electrically connecting said socket and said plug;

v) a lamp housing assembly, said lamp housing assembly including a terminal lead portion and a lamp portion, said lamp housing assembly accommodated in a void in said support plate such that said terminal lead portion is adjacent to said inner surface of said support plate and said lamp portion is adjacent to said outer surface of said support plate; and vi) second means for electrical conduction, said second means for electrical conduction electrically connecting said lamp housing with said plug; and e) a miniature building, said miniature building resting on said support plate of said at least one interconnectable base assembly and surrounding said lamp housing assembly, wherein, a number of said at least one interconnectable base assemblies are connected, in any order, between said first end unit and said second end unit and to said power supply.

4. An interconnectable base assembly and miniature building comprising:

a) a support plate, said support plate including a top portion and peripheral walls, said top portion and said peripheral walls defining a cavity having an inner volume and an outside space and defining an inner surface of said top portion and an outer surface of said top portion, said peripheral walls having a lower edge surface located opposite said support plate, said lower edge surface defining a substantially flat plane such that said interconnectable base assembly may stably rest on a flat surface;

b) a socket, said socket i) fitted onto one of said peripheral walls, and ii) adapted to accept a plug whereby an electrical connection and a mechanical connection may be formed;

c) a plug, said plug i) adapted to fit into a socket whereby an electrical connection and a mechanical connection may be formed, wherein said mechanical connection permits the interconnectable base to be rotated about an axis defined by said plug, and ii) fitted into a second one of said peripheral walls and projecting beyond an outside surface of said second one of said peripheral wall;

d) a first electrical conductor, said first electrical conductor i) electrically connecting said socket and said plug, and ii) located within said inner volume defined by said cavity;

e) a lamp housing assembly, said lamp housing assembly i) located on said outer surface of said top portion of said support plate; and ii) having electrical leads within said inner volume defined by said cavity;

f) a second electrical conductor, said second electrical conductor electrically connecting said electrical leads of said lamp housing assembly and said plug; and g) a miniature building, said miniature building resting on said support plate of said interconnectable base assembly and surrounding said lamp housing assembly.

5. An arrangement of miniature buildings including:

a) a power supply;

b) a first end unit including a plug connector;

c) a second end unit including a socket connector;

d) at least one interconnectable base assembly adapted to accommodate a miniature building including:

i) a support plate, said support plate including a top portion and peripheral walls, said top portion and said peripheral walls defining a cavity having an inner volume and an outside space and defining an inner surface of said top portion and an outer surface of said top portion, said peripheral walls having a lower edge surface located opposite said support plate, said lower edge surface defining a substantially flat plane such that said interconnectable base assembly may stably rest on a flat surface;

ii) a socket, said socket

A) fitted onto one of said peripheral walls, and

B) adapted to accept a plug whereby an electrical connection and a mechanical connection may be formed;

iii) a plug, said plug,

A) fitted onto a second one of said peripheral walls and projecting beyond an outside surface of said second one of said peripheral walls, and B) adapted to fit into a socket whereby an electrical connection and a mechanical connection may be formed, wherein said mechanical connection permits the interconnectable base to be rotated about an axis defined by said plug;

iv) a first electrical conductor, said first electrical conductor electrically connecting said socket and said plug;

v) a lamp housing assembly, said lamp housing assembly

A) connected to said outside surface of said support plate, and

B) having electrical leads within said inner volume of said cavity; and vi) a second electrical conductor, said second electrical conductor electrically connecting said lamp housing with said plug; and e) a miniature building, said miniature building resting on said support plate of said at least one interconnectable base assembly and surrounding said lamp housing assembly, wherein, a number of said at least one interconnectable base assemblies are connected, in any order, between said first end unit and said second end unit and to said power supply.

6. An arrangement of miniature buildings including:

a) a power supply;

b) a first end unit including a plug connector:

c) a second end unit including a socket connector;

d) at least one interconnectable base assembly adapted to accommodate a miniature building including:

i) a support plate;

ii) a socket, said socket adapted to accept a plug whereby an electrical and mechanical connection may be formed;

iii) a plug, said plug adapted to fit into a socket whereby an electrical and mechanical connection may be formed, wherein said mechanical connection permits the interconnectable base to be rotated about an axis defined by said plug;

iv) a first electrical conductor, said first electrical conductor electrically connecting said socket and said plug;

v) a lamp housing assembly, said lamp housing assembly including a terminal lead portion and a lamp portion; and vi) a second electrical conductor, said second electrical conductor electrically connecting said lamp housing with said plug; and e) a miniature building, said miniature building resting on said support plate of said at least one interconnectable base assembly and surrounding said lamp housing assembly, wherein, a number of said at least one interconnectable base assemblies are connected, in any order, between said first end unit and said second end unit and to said power supply.

7. A base assembly and miniature building which is interconnectable with similar base assemblies to form a series of buildings, comprising:

a) a support plate, said support plate including a top portion and a peripheral wall portion defining a cavity, said peripheral wall having a lower edge surface located opposite said support plate, said lower edge surface defining a substantially flat plane such that said interconnectable base assembly may stably rest on a flat surface;

b) a socket, said socket adapted to accept a plug disposed on an adjacent base assembly whereby an electrical connection and a mechanical connection may be formed;

c) a plug, said plug adapted to fit into a socket disposed on an adjacent base assembly whereby an electrical connection and a mechanical connection may be formed;

d) a first electrical conductor electrically connecting said socket and said plug;

e) a lamp housing assembly, said lamp housing assembly connected to said top portion of said support plate;

f) a second electrical conductor electrically connecting said lamp housing assembly and said plug; and g) a miniature building disposed on said support plate of said interconnectable base assembly and surrounding said lamp housing assembly.

* * * * *